US009174266B2

(12) United States Patent
Pautler

(10) Patent No.: US 9,174,266 B2
(45) Date of Patent: Nov. 3, 2015

(54) MANIFOLD BENDING SUPPORT

(71) Applicant: DELPHI TECHNOLOGIES, INC., Troy, MI (US)

(72) Inventor: Donald R. Pautler, Lockport, MI (US)

(73) Assignee: Delphi Technologies, Inc., Troy, MI (US)

( * ) Notice: Subject to any disclaimer, the term of this patent is extended or adjusted under 35 U.S.C. 154(b) by 109 days.

(21) Appl. No.: 13/873,549

(22) Filed: Apr. 30, 2013

(65) Prior Publication Data

US 2013/0232776 A1 Sep. 12, 2013

Related U.S. Application Data

(62) Division of application No. 12/778,565, filed on May 12, 2010, now Pat. No. 8,516,701.

(51) Int. Cl.

| | |
|---|---|
| ***B21D 51/38*** | (2006.01) |
| ***F28F 9/02*** | (2006.01) |
| ***B21D 53/06*** | (2006.01) |
| ***B21D 7/022*** | (2006.01) |
| *F28D 1/053* | (2006.01) |

(52) U.S. Cl.

CPC ..... *B21D 53/06* (2013.01); *B21D 7/022* (2013.01); *F28F 9/02* (2013.01); *F28D 1/05366* (2013.01); *F28F 2009/0285* (2013.01); *Y10T 29/4935* (2015.01); *Y10T 29/49368* (2015.01); *Y10T 29/49389* (2015.01); *Y10T 29/53122* (2015.01)

(58) Field of Classification Search

CPC ..... F28F 9/0243; F28F 9/0212; F28F 9/0224; B21D 53/085

USPC ..... 29/890.052, 890.04; 165/173, 174

See application file for complete search history.

(56) References Cited

U.S. PATENT DOCUMENTS

| | | | | |
|---|---|---|---|---|
| 1,417,691 | A * | 5/1922 | Romans | 60/325 |
| 5,125,454 | A * | 6/1992 | Creamer et al. | 165/173 |
| 5,251,857 | A * | 10/1993 | Grice et al. | 248/62 |
| 5,253,837 | A * | 10/1993 | Loux | 248/250 |
| 5,390,882 | A * | 2/1995 | Lee et al. | 248/68.1 |
| 5,460,342 | A * | 10/1995 | Dore et al. | 248/74.2 |
| 5,553,975 | A * | 9/1996 | Elkins | 405/184.4 |
| 5,820,048 | A * | 10/1998 | Shereyk et al. | 248/68.1 |
| 5,931,423 | A * | 8/1999 | Heideloff | 248/74.4 |
| 5,934,366 | A * | 8/1999 | Gowan | 165/174 |
| 5,941,303 | A * | 8/1999 | Gowan et al. | 165/176 |
| 6,254,040 | B1 * | 7/2001 | Mc Grath | 248/62 |
| 6,263,954 | B1 * | 7/2001 | Nakayama | 165/67 |
| 6,550,962 | B1 * | 4/2003 | Yang et al. | 374/147 |
| 6,672,026 | B2 * | 1/2004 | Sumerak | 52/690 |
| 6,682,025 | B2 * | 1/2004 | Turner et al. | 248/65 |

(Continued)

*Primary Examiner* — David Angwin

(74) *Attorney, Agent, or Firm* — Brinks Gilson & Lione

(57) ABSTRACT

A bending support having a planar bracing member with a length (L) that is substantially equal to that of the inner diameter (I.D.) of the manifold header that the bending support is ultimately inserted in. Extending perpendicularly from a surface of the bracing member is a pair of bracketing members. The pair of bracketing member and the portion of the planar bracing member therebetween defines a refrigerant conduit clip. The interior surface of the refrigerant conduit clip includes a skived pattern defining a plurality of teeth or protrusions that aids in the attachment of the refrigerant conduit clip onto an internal refrigerant conduit. An aperture located on the planar bracing member between the pair of bracketing member provides an unobstructed path for refrigerant flow to the refrigerant conduit.

7 Claims, 6 Drawing Sheets

(56) References Cited

U.S. PATENT DOCUMENTS

| | | | | |
|---|---|---|---|---|
| D531,010 | S * | 10/2006 | Vrame | D8/354 |
| 7,284,302 | B2 * | 10/2007 | Lares | 24/16 PB |
| 7,621,488 | B2 * | 11/2009 | Miller | 248/71 |
| 7,661,634 | B2 * | 2/2010 | Thompson | 248/74.3 |
| 7,832,420 | B2 * | 11/2010 | Hoskisson et al. | 137/318 |
| 7,946,036 | B2 * | 5/2011 | Beamer et al. | 29/890.052 |
| 8,516,701 | B2 * | 8/2013 | Pautler | 29/890.052 |
| 2002/0029872 | A1 * | 3/2002 | Jamison et al. | 165/153 |
| 2003/0102116 | A1 * | 6/2003 | Memory et al. | 165/173 |
| 2003/0121649 | A1 * | 7/2003 | Seiler et al. | 165/167 |
| 2003/0159813 | A1 * | 8/2003 | Baldantoni | 165/140 |
| 2006/0118289 | A1 * | 6/2006 | Jung et al. | 165/178 |
| 2007/0131385 | A1 * | 6/2007 | Misiak et al. | 165/78 |
| 2008/0060199 | A1 * | 3/2008 | Fuller et al. | 29/890.052 |
| 2011/0174472 | A1 * | 7/2011 | Kurochkin et al. | 165/174 |
| 2012/0000635 | A1 * | 1/2012 | Porter et al. | 165/173 |
| 2012/0297723 | A1 * | 11/2012 | Siddiqui et al. | 52/698 |

* cited by examiner

MANIFOLD BENDING SUPPORT

RELATED APPLICATION

This Application is a Divisional of and claims priority to U.S. patent application Ser. No. 12/778,565, filed on May, 12, 2010, titled A MANIFOLD BENDING SUPPORT AND METHOD FOR USING SAME, the disclosure of which is incorporated herein by reference in its entirety.

TECHNICAL FIELD OF INVENTION

The subject invention relates generally to a manifold bending support, and more particularly to a bending support adapted to be inserted into a manifold header of a heat exchanger to prevent the manifold header from collapsing during the bending of the manifold.

BACKGROUND OF THE INVENTION

Due to their high heat transfer efficiency, automotive style brazed heat exchangers have been modified for residential and commercial air conditioning and heat pump applications. A typical modified automotive heat exchanger includes a pair of manifold headers having a plurality of flat tubes in hydraulic connection therebetween for refrigerant flow from one manifold header to the other. Having uniform refrigerant distribution through the plurality of flat tubes is important for optimal heat transfer. To provide for uniform refrigerant distribution through the core of flat tubes, larger diameter manifold headers are used in conjunction with internal refrigerant distribution and collection conduits in the inlet and outlet manifold headers, respectively.

In order to meet packaging constraints for residential and commercial applications, the larger diameter manifold headers of the modified automotive heat exchanger may be bent about an axis on a mandrel. With larger diameter manifold headers, the bending process has a tendency to deform the wall of the manifold header into a substantially egg-shaped cross sectional profile.

It is desirable to have a bending support adapted for use in the bending of a manifold header of a heat exchanger, in which the bending support prevents stress concentrations from deforming the inner radius of the bend. It is further desirable to have a bending support adapted to hold and maintain the internal refrigerant conduit in a predetermined position within the manifold header during the bending process and which assists in the bending of the internal refrigerant conduit to conform to the bend contour of the manifold.

SUMMARY OF THE INVENTION AND ADVANTAGES

An embodiment of the present invention provides a bending support adapted to be inserted into a manifold header that has an internal refrigerant conduit of a heat exchanger assembly and a method of using the bending support in the manufacturing of the heat exchanger assembly.

The bending support includes a substantially planar bracing member with a length (L) that is substantially equal to that of the inner diameter (I.D.) of the manifold header that the bending support is ultimately inserted in. Extending from a surface of the bracing member is a pair of bracketing members that are spaced apart at a distance substantially equal that of the outer diameter (O.D.) of the refrigerant conduit. The pair of bracketing member and the portion of the planar bracing member therebetween define a refrigerant conduit clip. The interior surface of the refrigerant conduit clip includes a skived pattern defining a plurality of teeth or protrusions that aids in the engagement of the refrigerant conduit clip onto the internal refrigerant conduit. An aperture located on the planar bracing member provides an unobstructed refrigerant pathway for refrigerant flow to or from the internal refrigerant conduit.

A plurality of the bending supports are oriented and clipped onto the refrigerant conduit at predetermined locations prior to the refrigerant conduit being inserted into the manifold header. A first bending support is clipped onto the center or apex A of the desired bend, a second and third bending supports are clipped onto either end of the bend as it transitions into a straight run. The header manifold is oriented toward a mandrel where the bracing member of the bending support is substantially perpendicular to the work surface of the mandrel. The bending support substantially maintains the inner diameter of the manifold header to prevent the manifold header from being crushed. Also, the bending support serves to maintain the refrigerant conduit in its desired position during the bending process.

Accordingly, the bending support maintains the diameter of the manifold header during the bending process to prevent the inner radius wall from collapsing or deforming. The bending support also holds and maintains the internal refrigerant conduit in a predetermined position during the bending process to conform to the bend contour of the manifold header, thereby preventing the refrigerant conduit from deforming.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
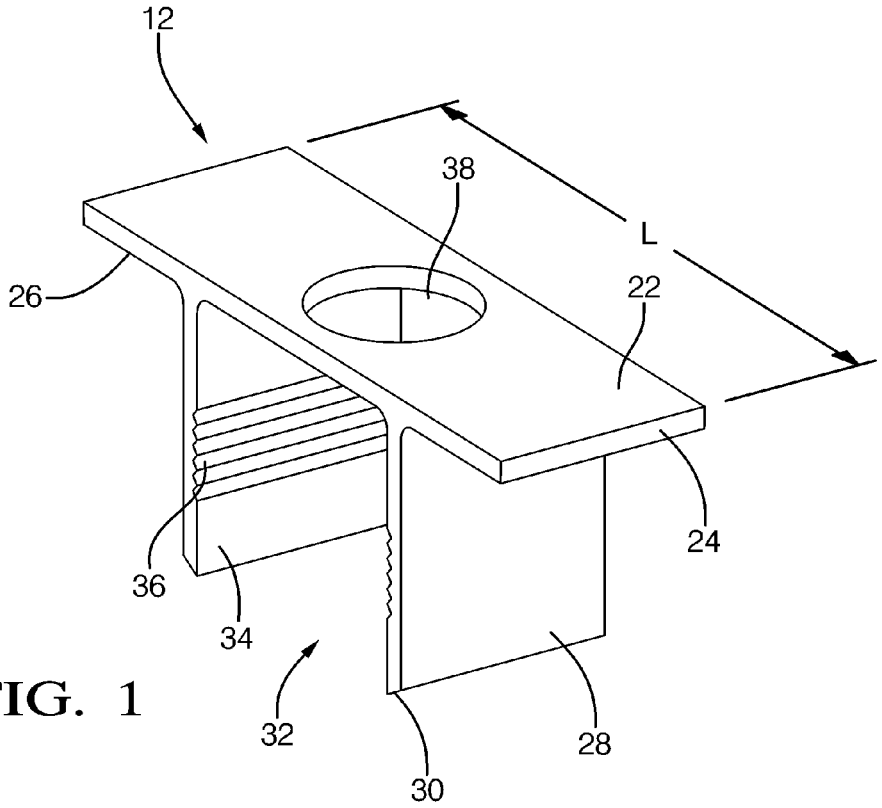
FIG. 1 shows a perspective view of one embodiment of the bending support.

This invention will be further described with reference to the accompanying drawings, wherein like numerals indicate corresponding parts throughout the views. The modified automotive heat exchanger represented in the drawings generally includes a first manifold header 14 having a substantially round cross-sectional area, a second manifold (not shown) spaced apart from the first manifold header 14, an internal refrigerant distribution or collection conduit 20 extending within one or both of the manifold headers, and a plurality of flat tubes 44 interconnecting the first 14 and second manifold headers for refrigerant flow from one manifold header to the other. The modified automotive heat exchanger shown is for illustrative purposes and represents one of many exemplary embodiment of the invention; therefore, the modified automotive heat exchanger shown should not be considered as a limiting example. In the following description of the bending support 12 and the method of using the bending support 12, the modified automotive heat exchanger will be generically referred to as a heat exchanger assembly 10.

Shown in FIGS. 1-6B is a bending support 12 adapted to be inserted into a manifold header 14 of a heat exchanger assembly 10. The bending support 12 has features that enable it to support the inner radius wall 16, best shown in FIG. 5B, of the manifold header 14 during the bending process to prevent the inner radius wall 16 from forming an egg-shaped cross sectional profile. The bending support 12 also has features that hold and maintain the internal refrigerant conduit 20 in a predetermined position during the bending process to conform to the bend contour of the manifold header 14, thereby preventing the refrigerant conduit 20 from deforming. The details and advantages of these features will be clearer with the description that follows.

Figure 2:
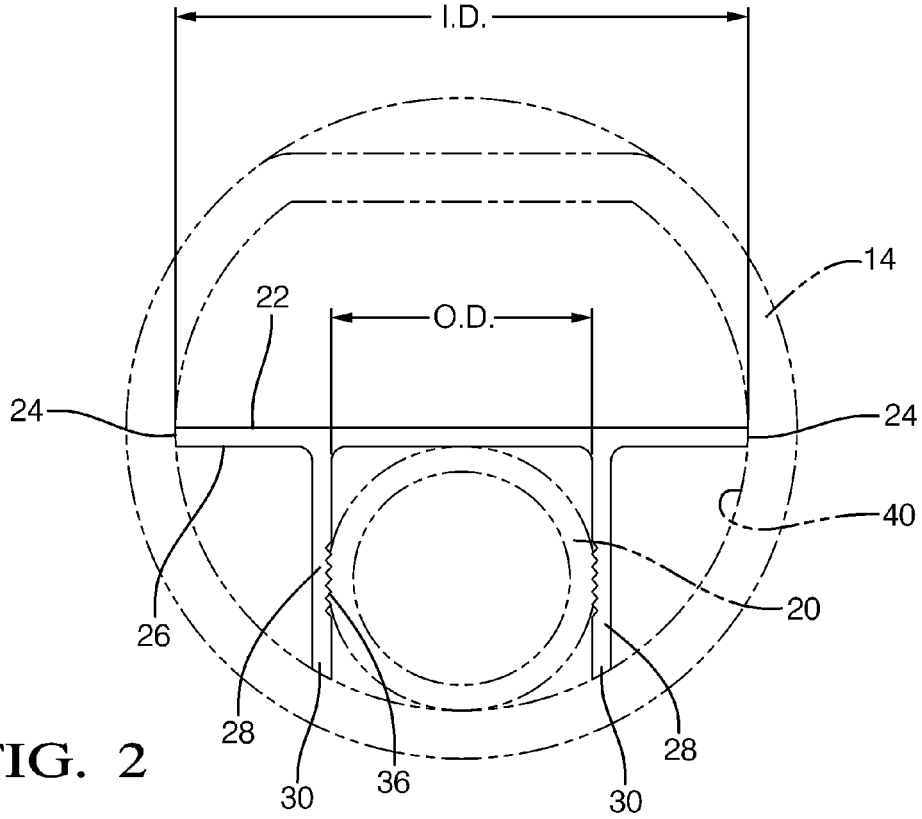
FIG. 2 shows a cross-sectional end view of a manifold header having a bending support maintaining a refrigerant conduit in a predetermined position.

FIGS. 1 and 2 show a bending support 12 having a substantially planar bracing member 22. The bracing member 22 has a length (L) that is substantially equal to that of the inner diameter (I.D.) of the manifold header 14 that the bending support 12 is ultimately inserted in. The bracing member 22 includes two opposing bracing member edges 24 and a bracing member surface 26.

Extending substantially perpendicularly from the bracing member surface 26 is a pair of bracketing members 28. Each of the two bracketing members 28 includes a bracketing member interior surface 34 and a bracketing member distal end 30. The pair of bracketing members 28 together with a portion of the bracing member 22 therebetween define a refrigerant conduit clip 32. The pair of bracketing members 28 is spaced at a distance substantially equal that of the outer diameter (O.D.) of the refrigerant conduit 20 that the bending support 12 ultimately engages and includes an interior bracketing member surface 34 having a skived pattern 36 defining a plurality of teeth or protrusions 36. The portion of the bracing member 22 between the pair of bracketing members 28 defines an aperture 38.

FIG. 2 shows the bending support 12 inserted into the interior of the header manifold 14. The bending support 12 is sized such that the opposing bracing member edges 24 and the bracketing member distal ends 30 abut the interior surface 40 of manifold header 14. It is preferable that the bracing member 22 extends across the inner diameter of the manifold header 14. To ensure a secure fit, the length (L) of the bracing member 22 may be sized slightly longer than the inner diameter (I.D.) of the manifold header 14 to form an interference fit. To maximize the contact area to ensure a tight fit, the bracketing member distal ends 30 and bracing member edges 24 may be contoured to conform to the curvature of the interior surface 20 of the manifold header 14. The bending support 12 may be fabricated as a continuous aluminum extrusion and then cut to the desired length.

Figure 3:
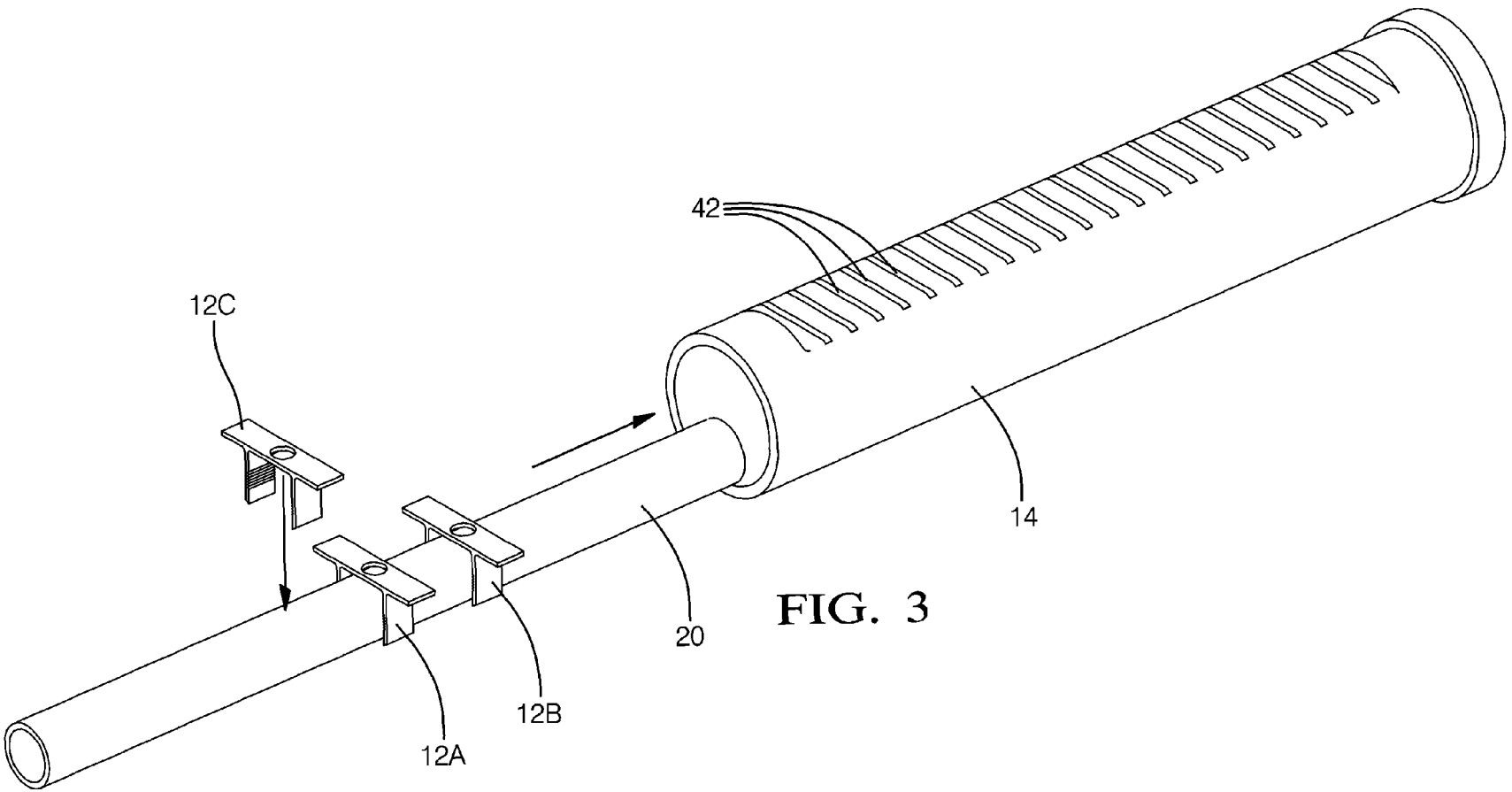
FIG. 3 shows a perspective view of a plurality bending supports being assembled onto the refrigerant conduit prior to the insertion of the refrigerant conduit assembly into the manifold header.

FIG. 3 shows a plurality of bending supports 12 being clipped onto the refrigerant conduit 20 prior to the insertion of the refrigerant conduit 20 into the interior of the manifold header 14. Each bending support 12 is pre-oriented and clipped onto a strategic predetermined location along the refrigerant conduit 20 as described in the following.

Figure 5A:
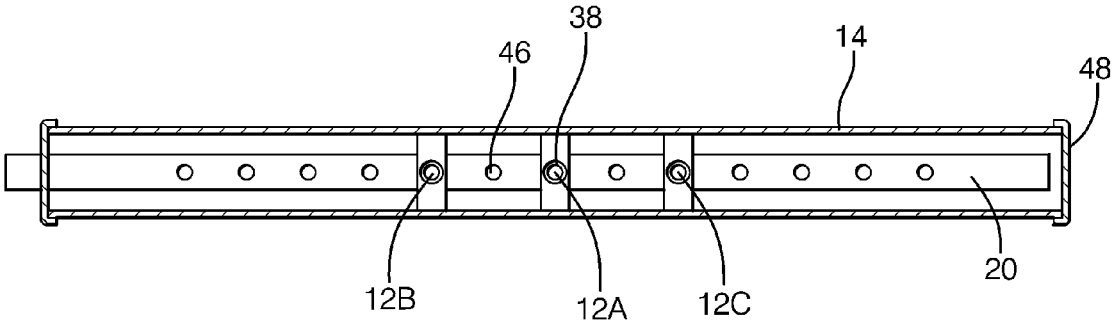
FIG. 5A shows a cross-sectional view of the manifold header having multiple bending supports engaged to the refrigerant conduit.
Figure 5B:
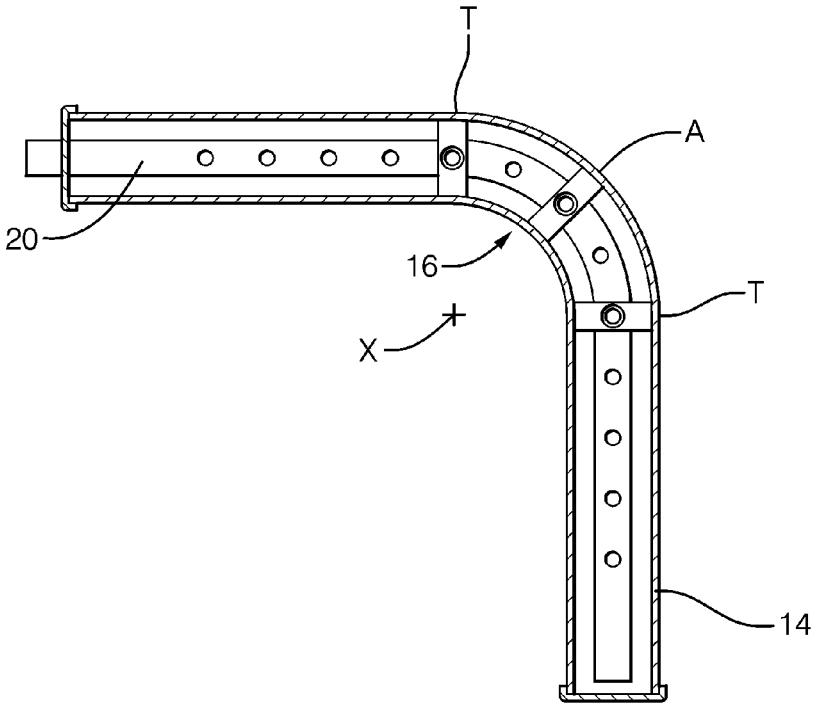
FIG. 5B shows a cross-sectional view of the manifold header of FIG. 5A bent at a 90 degree angle about an X-axis.

Prior to the insertion of the refrigerant conduit 20 into the manifold header 14, the bend apex of the refrigerant conduit 20 corresponding to the desired bend apex (A) of the manifold header 14 is identified. A first bending support 12A, a second bending support 12B, and a third bending support 12C are provided. With reference to FIGS. 3, 5A, and 5B, the first bending support 12A is clipped onto the refrigerant conduit 20 at or about the portion of the refrigerant conduit 20 corresponding to the desired bend apex (A) of the manifold header 14. The first bending support 12A is oriented in a direction in which one of the bracing member edges 24 is directed toward the X-axis, the axis about which the manifold header 14 is bent and the length (L) of the bracing member 22 extends radially from the X-axis. The second and third bending supports 12B, 12C are clipped onto the refrigerant conduit 20 at or about the portions that correspond to the bend transitions (T) of the manifold header 14. The second and third bending supports 12B, 12C are oriented in the same direction as that of the first bending support 12A, in which one of the bracing member edges 24 is directed toward the X-axis.

Figure 4:
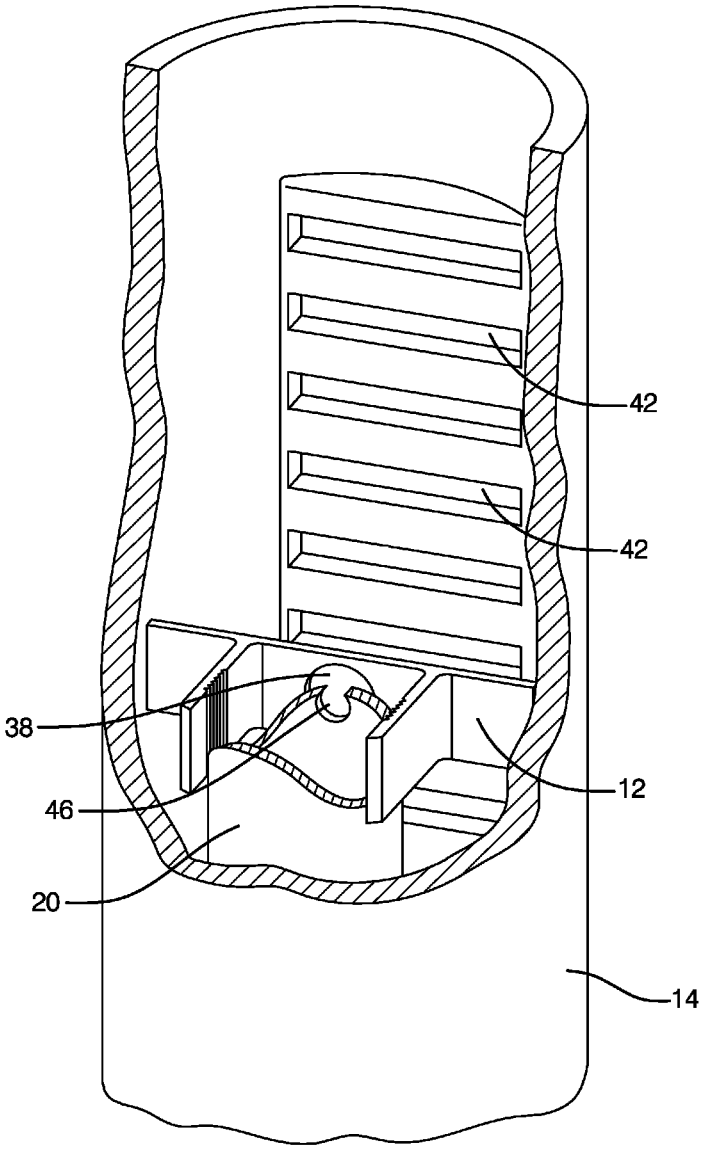
FIG. 4 shows a partial cut-away perspective view of a manifold header having a bending support engaged to the refrigerant conduit.

Shown in FIG. 4 is a partial cut-away perspective view of the manifold header 14 having a bending support 12 clipped onto the refrigerant conduit 20. The manifold header 14 shown includes a plurality of slots 42 for the insertion of flat tubes 44. In this exemplary embodiment, the aperture 38 of the bending support is aligned with the refrigerant distribution or collection ports 46 of the refrigerant conduit 20 for unrestricted refrigerant flow to or from the refrigerant conduit 20. However, it is not necessary for the aperture 38 to be directly aligned with the ports 46 of the refrigerant conduit 20.

Shown in FIG. 5A, three bending supports 12A, 12B, 12C are clipped onto the refrigerant conduit 20 and the assembly is inserted into the manifold header 14. At this stage of the assembly, manifold caps 48 may be placed on either end of the manifold header 14, one end of the flat tubes 44 inserted into the corresponding tube slots 42, and the other end of the flat tubes 44 may be inserted into the corresponding tube slots of the other manifold header (not shown) forming the heat exchanger assembly 10. The assembly may be brazed into a solid integral heat exchanger assembly 10. After brazing, the manifold headers 14 may be bent on a mandrel to conform the heat exchanger assembly 10 to the desired packaging requirement. Alternatively, the headers manifold 14 with the inserted refrigerant conduits 20 and bending supports 12 may be individually bent prior to the assembly and brazing of the remaining components of the heat exchanger assembly.

Shown in FIG. 5B, is cross sectional view of a bent manifold header 14 forming a right angle along with the relative location of the three bending supports 12A, 12B, and 12C. The first bending support 12A is located at the center or apex A of the bend; the second and third bending support 12B, 12C are located at either end of the bend as it transitions into a straight run.

Figure 6A:
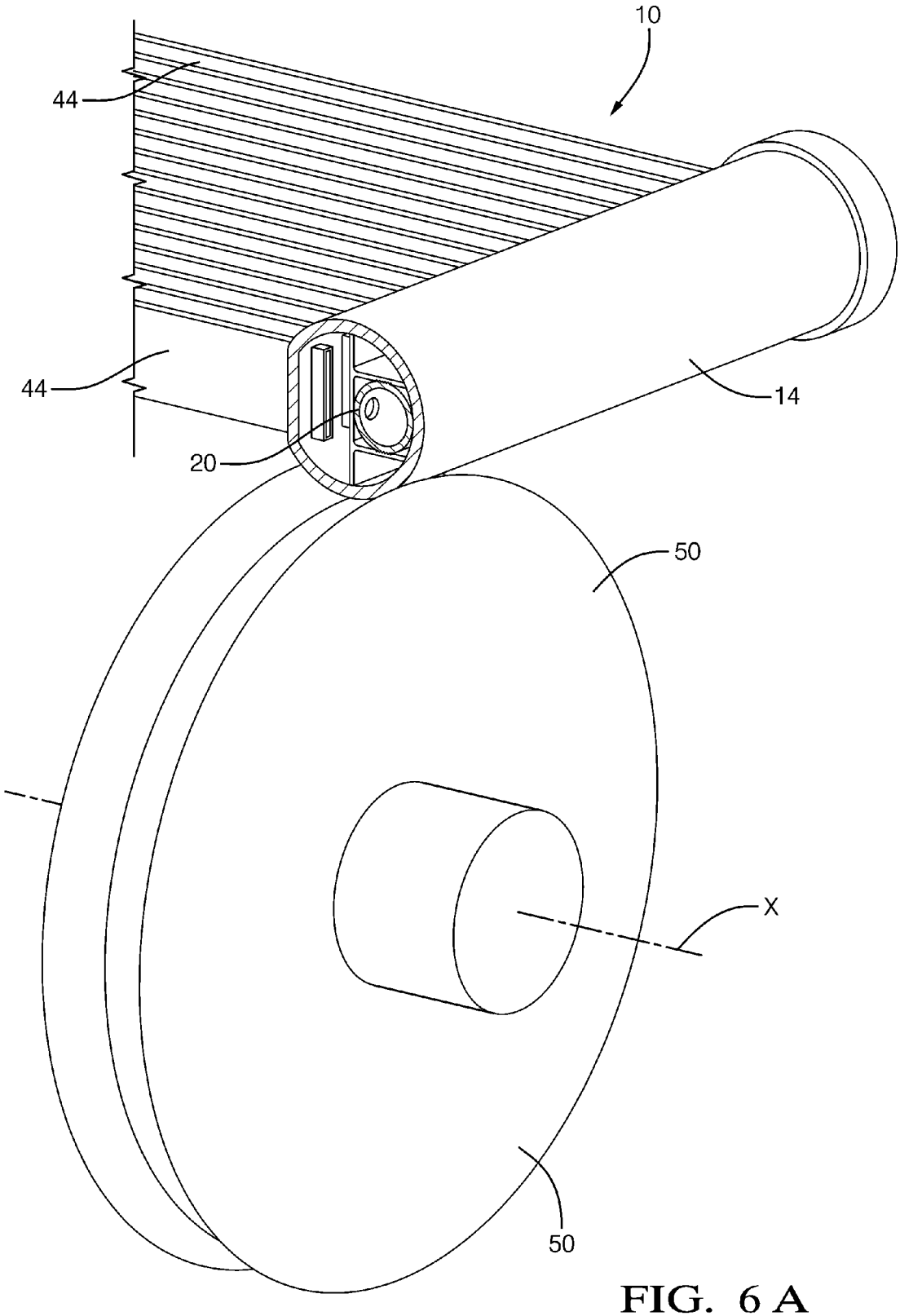
FIG. 6A shows a cut-away perspective view of the manifold header having the bending support properly positioned on a mandrel.
Figure 6B:
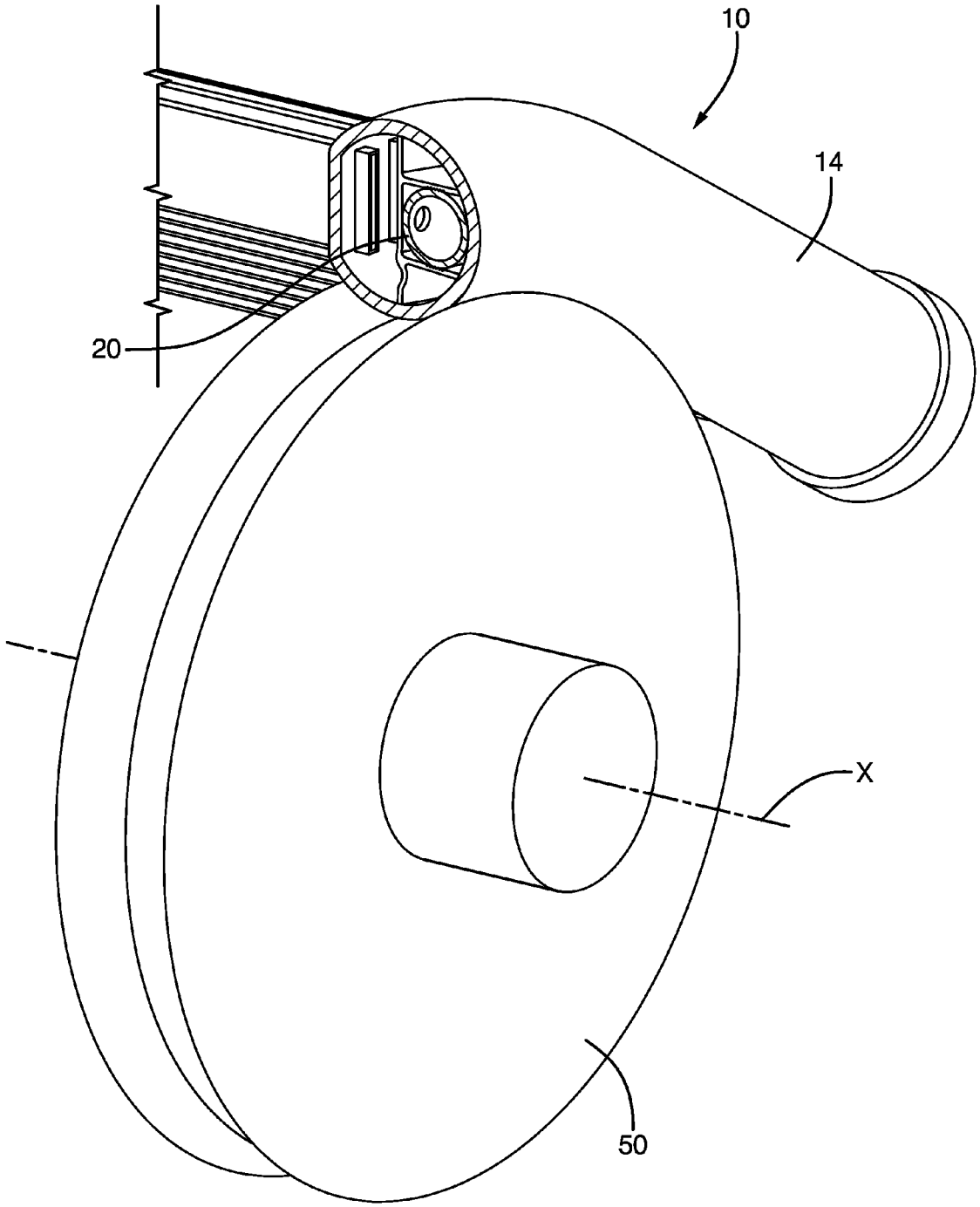
FIG. 6B shows the cut-away perspective view of the manifold header of FIG. 6A being bent about the X-axis on the mandrel.

Shown in FIG. 6A is a heat exchanger assembly 10 having the header manifold 14 positioned onto a mandrel 50. The header manifold 14 is oriented where the bracing member 22 of the bending support 12 is substantially perpendicular to the work surface of the mandrel. As a force is applied causing the header manifold 14 to bend onto the work surface and about the X-axis, a portion of the force is transmitted to the refrigerant conduit 20 via the bending support 12 assisting in the bending of the refrigerant conduit 20 to a curvature that closely conforms to the bend curvature of the manifold header 14; thereby preventing any pinch points from forming in the refrigerant conduit 20. The bending support 12 also aids in maintaining the desired position of the refrigerant conduit 20 relative to the manifold header 14 during the bending process.

The bending support 12 supports the inner radius of the manifold header 14 during the bending process, thereby providing the advantage of preventing stress concentrations from deforming the inner radius of the bend. The bending support 12 maintains the internal refrigerant conduit 20 in a predetermined position during the bending process to conform the bend of the refrigerant conduit 20 to the bend of the manifold header 14, thereby providing the advantage of preventing crimps in the refrigerant conduit 20.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Having described the invention herein, I claim:

1. For use with a cylindrical heat exchanger manifold header having an interior surface with a predetermined inner surface diameter, and with a cylindrical refrigerant conduit of smaller diameter to be supported within said manifold, a bending support configured to be inserted into said manifold header, comprising:

a planar bracing member having two opposite facing member edge surfaces, the bracing member includes a length substantially equal to said manifold inner surface such that said member edge surfaces abut an interior surface of the manifold header to provide an interference fit;

a pair of bracketing members extending perpendicularly from one side of said bracing member and spaced apart substantially by the diameter of said refrigerant conduit so as to tightly grip the outside thereof and terminating in distal ends that abut said manifold interior surface when said bracing member edge surfaces abut said interior surface, wherein said bending support supports the interior of said manifold surface and supports said refrigerant conduit in position when said manifold and supported conduit are bent in a radius while the plane of said bracing member is perpendicular to the axis about which said radius is bent.

2. The bending support of claim 1, further comprising a pair of bracketing members extending from a surface of said bracing member.

3. The bending support of claim 2, wherein said pair of bracketing members and a portion of said bracing member between said pair of bracketing members are configured such that such that said pair of bracketing members cooperates with said portion of said bracing member between said pair of bracketing members to securely clip onto an outer diameter of a refrigerant conduit.

4. The bending support of claim 3, wherein each of said pair bracketing members includes an interior surface oriented toward the other, and wherein said interior surface includes a skived portion defining a plurality of saw tooth surfaces.

5. The bending support of claim 4, wherein each of said pair of bracketing members includes a bracketing member end, and wherein said bracketing members includes a length such that said bracketing member ends abut the interior surface of the manifold header to provide an interference fit.

6. The bending support of claim 5, wherein said bracing member between said pair of bracketing members defines an aperture.

7. The bending support of claim 5, wherein said edges of said bracing member and ends of said bracketing member are contoured to the interior surface of the manifold header.

* * * * *